US010895255B2

(12) United States Patent
Kim et al.

(10) Patent No.: US 10,895,255 B2
(45) Date of Patent: Jan. 19, 2021

(54) RECIPROCATING TYPE COMPRESSOR

(71) Applicant: LG ELECTRONICS INC., Seoul (KR)

(72) Inventors: Seungwook Kim, Seoul (KR); Kyeong Ho Kim, Seoul (KR); Jinkook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 16/135,448

(22) Filed: Sep. 19, 2018

(65) Prior Publication Data

US 2019/0093646 A1 Mar. 28, 2019

(30) Foreign Application Priority Data

Sep. 25, 2017 (KR) ..... 10-2017-0123777

(51) Int. Cl.

| | |
|---|---|
| ***F04B 39/02*** | (2006.01) |
| ***F04B 39/00*** | (2006.01) |
| ***F04B 53/14*** | (2006.01) |
| ***F04B 35/04*** | (2006.01) |
| *F04B 27/04* | (2006.01) |

(52) U.S. Cl.

CPC ..... *F04B 53/14* (2013.01); *F04B 35/04* (2013.01); *F04B 39/0005* (2013.01); *F04B 39/0022* (2013.01); *F04B 39/0094* (2013.01); *F04B 39/0246* (2013.01); *F04B 27/0409* (2013.01); *F04B 27/0423* (2013.01)

(58) Field of Classification Search

CPC .. F04B 39/0246; F04B 35/04; F04B 39/0005; F04B 39/0022; F04B 39/0094; F04B 53/14; F04B 27/0409; F04B 27/0423

See application file for complete search history.

(56) References Cited

U.S. PATENT DOCUMENTS

2011/0232416 A1* 9/2011 Kim ..... F04B 53/147 74/605

FOREIGN PATENT DOCUMENTS

| | | |
|---|---|---|
| JP | 2001-082336 | 3/2001 |
| KR | 10-2005-0026797 | 3/2005 |
| KR | 10-2005-0054720 | 6/2005 |
| KR | 10-2005-0054721 | 6/2005 |
| KR | 1020050026797 A * | 10/2005 |

(Continued)

OTHER PUBLICATIONS

English Translation of KR 10-2005-0054720 Obtained May 7, 2020 (Year: 2020).*

(Continued)

*Primary Examiner* — Connor J Tremarche

(74) *Attorney, Agent, or Firm* — Ked & Associates LLP

(57) ABSTRACT

A reciprocating type compressor may include a crank shaft that is coupled to a rotor of a motor to receive a rotational force and a connecting rod that is coupled to a pin of the crank shaft and converts a rotational force of the crank shaft into a linear motion of a piston. The connecting rod may include a first end having a tubular body that includes a pin insertion hole into which the pin of the crank shaft is inserted and a socket that projects from the tubular body, a second end coupled with the piston, and a main body that extends between the first end and the second end and having a ball that is received inside of the socket.

17 Claims, 10 Drawing Sheets

(56) References Cited

FOREIGN PATENT DOCUMENTS

| | | | |
|---|---|---|---|
| KR | 1020050054720 A | * | 10/2005 |
| KR | 10-1514664 | | 4/2015 |

OTHER PUBLICATIONS

English Translation of KR 10-2005-0026797 Obtained May 7, 2020 (Year: 2020).*

Korean Office Action dated Oct. 22, 2018 issued in KR Application No. 10-2017-0123777.

International Search Report and Written Opinion dated Jan. 10, 2019 issued in International Application No. PCT/KR2018/010943.

* cited by examiner

RECIPROCATING TYPE COMPRESSOR

CROSS-REFERENCE TO RELATED APPLICATION(S)

This application claims priority to and the benefit of Korean Patent Application No. 10-2017-0123777, filed in Korea on Sep. 25, 2017, whose disclosure of which is incorporated herein by reference in its entirety.

BACKGROUND

1. Field

A reciprocating type compressor is disclosed herein.

2. Background

A compressor may be used in a vapor compression type refrigeration cycle such as a refrigerator or an air conditioner. Compressors may include a motor portion that generates power from an interior of a hermetic container and a compression portion that operates by receiving power from the motor portion.

Such a compressor may be divided into a reciprocating type, a rotary type, a vane type, and a scroll type depending on a method of compressing a refrigerant. Among them, the reciprocating type compressor may include a connecting rod coupled to a crank shaft of the motor portion and a piston coupled to the connecting rod so that a rotational force of the motor portion is converted into a linear motion of the piston.

For this purpose, one end of the connecting rod may be rotatably coupled to a pin of the crank shaft, and the other end of the connecting rod may be rotatably coupled to the piston. However, the connecting rod may be divided into a part connected to the crank shaft and a part connected to the piston and an additional part for coupling these parts may be used, thereby resulting in inconvenience in assembly. However, a frictional resistance may be present among the crank shaft, the connecting rod, and the piston, which may cause a problem that performance of the compressor is degraded or a life of a part is shortened.

BRIEF DESCRIPTION OF THE DRAWINGS

Embodiments will be described in detail with reference to the following drawings in which like reference numerals refer to like elements, and wherein.

DETAILED DESCRIPTION

Figure 1:
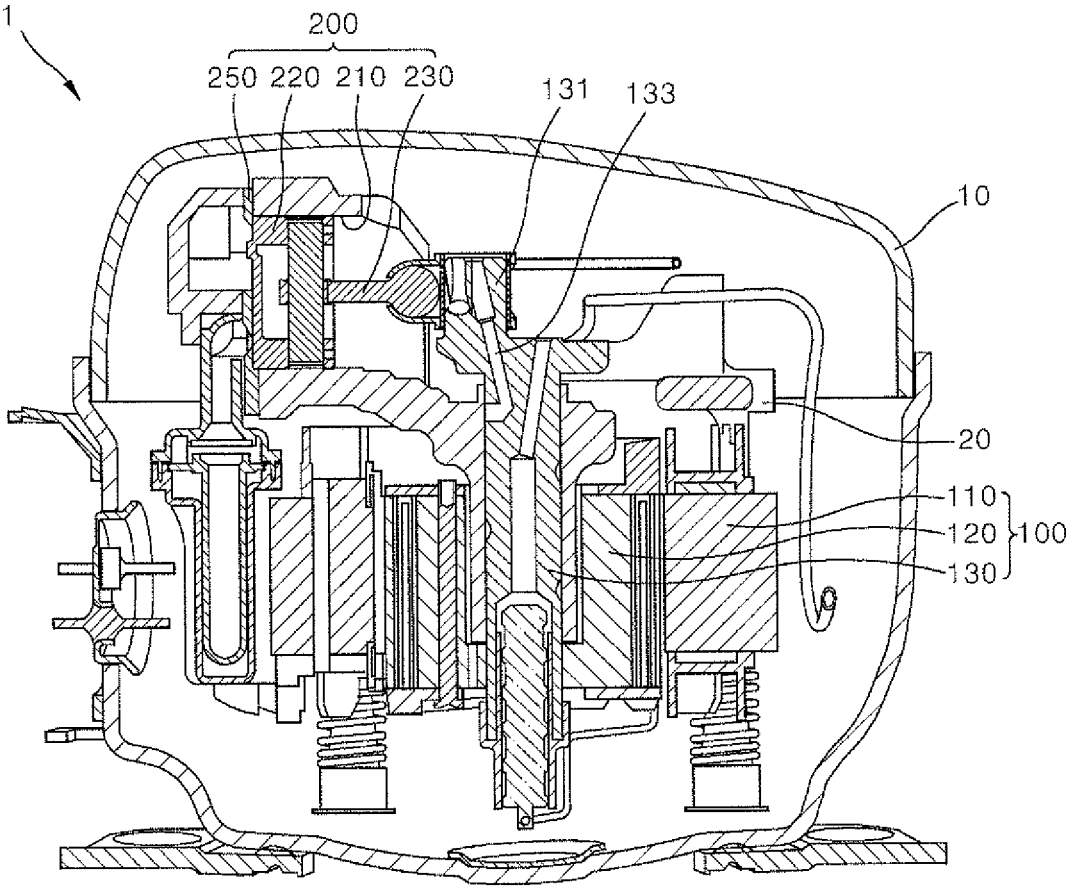
FIG. 1 is a cross-sectional view schematically illustrating a configuration of a reciprocating type compressor according to an embodiment.

A compressor may refer to a compressor applied to a vapor compression type refrigeration cycle such as a refrigerator or an air conditioner. FIG. 1 is a schematic cross-sectional view illustrating a configuration of a reciprocating type compressor according to an embodiment.

Referring to FIG. 1, a reciprocating type compressor 1 according to an embodiment may include a motor portion 100 and a compression portion 200. In other words, the reciprocating type compressor 1 may include the motor portion (or motor) 100 installed within a hermetic container 10 to perform forward and reverse rotation, and the compression portion or assembly 200 installed at an upper side of the motor portion 100 to compress a refrigerant by receiving a rotational force from the motor portion 100.

The motor portion 100 may use a constant-speed motor or an inverter motor capable of performing normal rotation and reverse rotation. The motor portion 100 may include a stator 110 supported by a frame 20 within the hermetic container 10, a rotor 120 rotatably installed at an inner side of the stator 110, and a crank shaft 130 that transfers a rotational force of the rotor 120 to the compression portion 200.

A pin portion (or pin) 131 of the crank shaft 130 may be coupled to a connecting rod 230. The connecting rod 230 may receive a rotational force of the crank shaft 130 and may allow a piston 220 coupled to an opposite side of the crank shaft 130 to linearly move (that is, a linear reciprocating motion) within a cylinder 210.

An oil passage 133 may be formed within the crank shaft 130 in a longitudinal direction of the shaft. The oil passage 133 may not be limited to a shown shape and may have various shapes different from it. The compression portion 200 may include the cylinder 210, the piston 220, the connection rod 230, and a valve assembly 250.

The cylinder 210 may include a compression space having a predetermined size, and may be arranged at an upper side of the hermetic container 10. The cylinder 210 may be formed in a cylindrical shape and may be formed integrally with a frame 20 or assembled to a frame 20 and coupled thereto.

The piston 220 may compress a refrigerant while linearly reciprocating within a compression space of the cylinder 211. The piston 220 may have a cylindrical shape having a closed end, and may be rotatably coupled to a piston connecting portion 235 of the connecting rod 230 by using a fastening pin 221. In this way, a coupling between the piston 220 and the connecting rod 230 may be formed.

A first end of the connecting rod 230 may be coupled to the pin portion 131 of the crank shaft 130, and a second end of the connecting rod 230 may be coupled to the piston 220. The connecting rod 230 may convert a rotational force of the crank shaft 130 into a linear motion of the piston 220.

The valve assembly 250 may be coupled to the cylinder 211, and may further include a plurality of valves that include a suction valve and a discharge valve. Meanwhile, a suction muffler, a discharge cover, and a discharge muffler, for example, may be further added in the compression portion 200.

Figure 2:
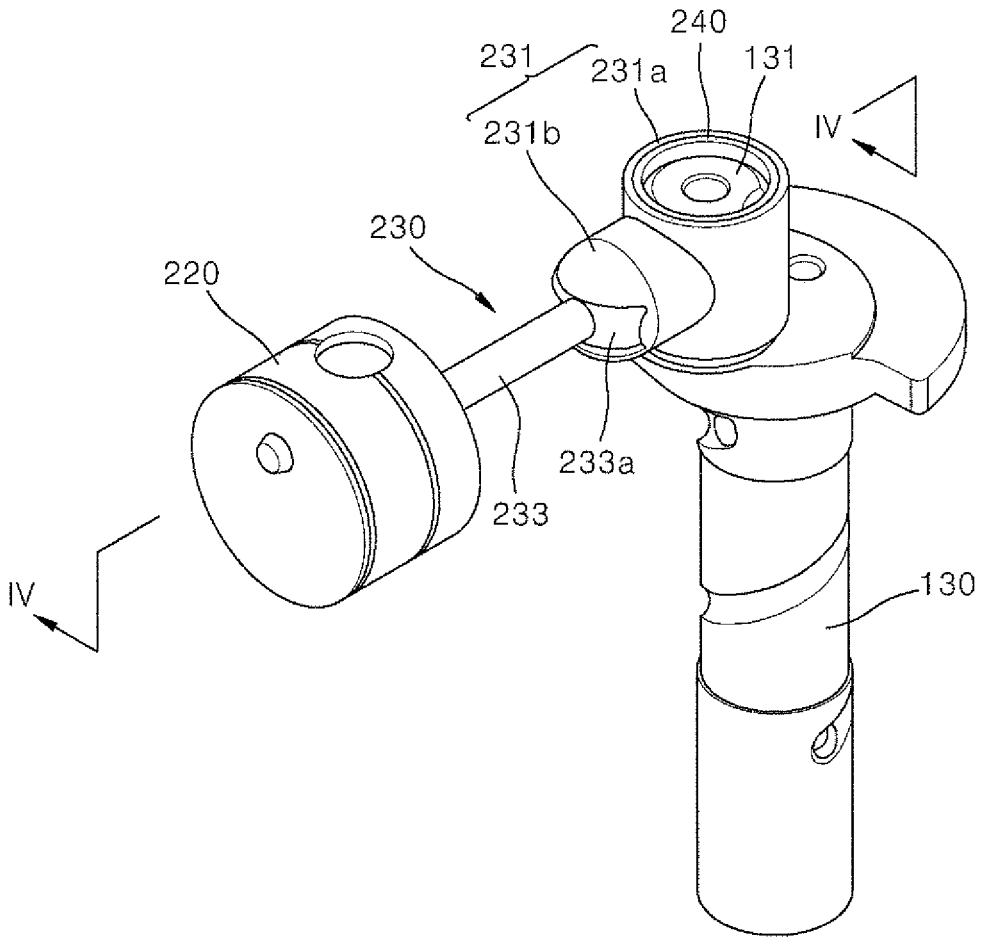
FIG. 2 is a perspective view schematically illustrating a coupling form of a crank shaft, a connecting rod, and a piston included in a reciprocating type compressor according to an embodiment.
Figure 3:
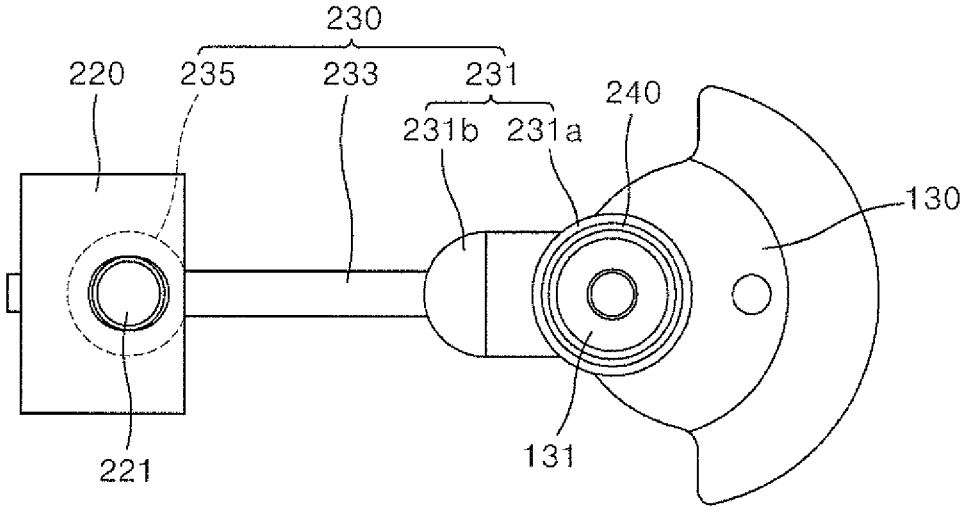
FIG. 3 is a top view schematically illustrating a coupling form of a crank shaft, a connecting rod, and a piston included in a reciprocating type compressor according to an embodiment.
Figure 4:
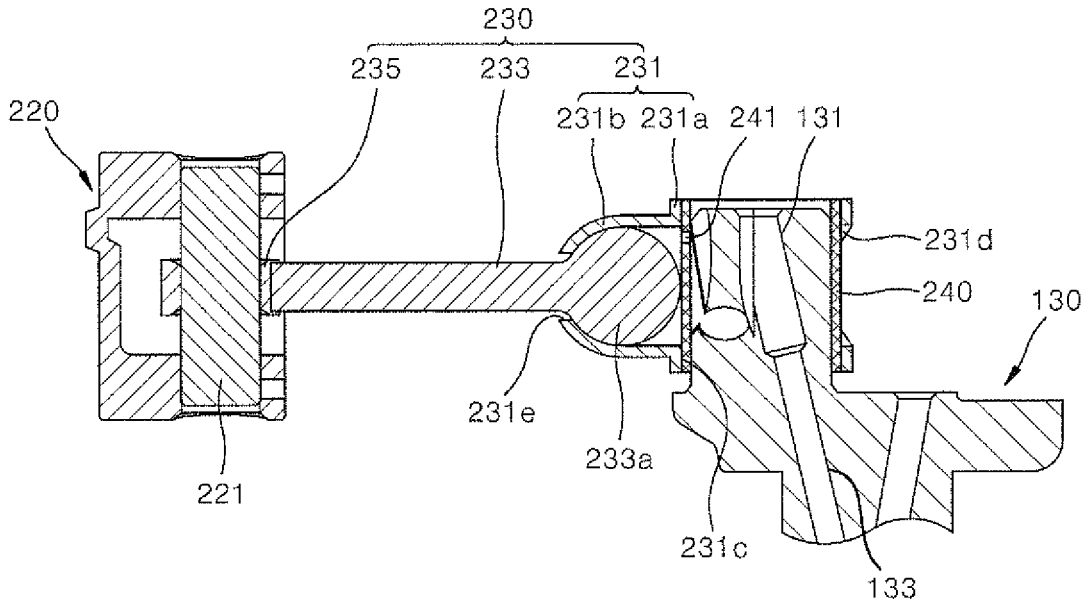
FIG. 4 is a cross-sectional view taken along line "IV-IV" of FIG. 2.

FIG. 2 and FIG. 3 are a perspective view and a top view schematically illustrating a coupling shape of a crank shaft, a connecting rod, and a piston included in a reciprocating type compressor according to an embodiment. FIG. 4 is a cross-sectional view taken along line "IV-IV" of FIG. 2.

Referring to FIG. 2 to 4, the first end of the shown connecting rod 230 may be coupled to the pin portion 131 of a crank shaft 130 and the second end thereof may be coupled to the piston 220. The connecting rod 230 may convert a rotational force of the crank shaft 130 into a linear motion of the piston 220.

For this purpose, the connecting rod 230 may include a shaft connecting portion (or first end or shaft connector) 231 that is connected to the pin portion 131 of the crank shaft 130, a piston connecting portion (or second end) 235 that is connected to the piston 220, and a rod portion (or main body) 233 that is connected between the shaft connecting portion 231 and the piston connecting portion 235. The shaft connecting portion 231 may include a tubular body 231*a* that includes a pin insertion hollow 231*c* into which the pin portion 131 of the crank shaft 130 is inserted.

The tubular body 231*a* may include a socket portion (or socket) 231*b*. A specific shape of the socket portion 231*b* may project outward from a circumferential surface of the tubular body 231*a* and may project so as to have a size and shape capable of storing a ball bearing or joint 233*a*. In other words, the ball bearing 233*a* provided at a first end of the rod portion 233 may be received inside of the socket portion 231*a*. Because of the ball bearing 233*a*, a frictional resistance of the rod portion 233 that is connected to the tubular body 231*a* may be greatly reduced.

The piston connecting portion 235 may be formed at an opposite side of the shaft connecting portion 231. The piston connecting portion 235 may be connected to the piston 220 by a coupling of a fastening pin 221 (see FIG. 4) that is inserted through the piston 220. For this purpose, the fastening pin 221 (see FIG. 4) may have an annular shape so as to be fitted and fixed within the piston.

The rod portion 233 may be connected in a rod-shape between the shaft connecting portion 231 and the piston connecting portion 235. The ball bearing 233*a* that is provided at the first end may be received in the socket portion 231*b* of the shaft connecting portion 231.

Accordingly, the connecting rod 230 included in a reciprocating type compressor 1 according to the embodiment may be connected between the pin portion 131 of the crank shaft 130 and the ball piston 220, and may convert the rotational force of the crank shaft 130 into the linear motion of the piston 220. Further, by using the ball bearing 233*a* at a connecting portion between the pin portion 131 of the crank shaft 130 and the connecting rod 230, it may be possible to apply a ball joint structure to reduce a frictional resistance.

According to the above configuration, the reciprocating type compressor 1 according to an embodiment may further include a bushing bearing 240 that is interposed between the tubular body 231*a* and the pin portion 131. The bushing bearing (or bushing) 240 may be inserted through a pin insertion hollow 231*c* (see FIG. 4) so that it is closely contacted to an inner circumferential surface of a tubular body 231*a*, and it may be closely contacted between the tubular body 231*a* and the pin portion 131.

As shown in FIG. 4, the bushing bearing 240 may contact the ball bearing 233*a* that is received inside of the socket portion 231*b* through an outer circumferential surface to prevent a disengagement of the ball bearing 233*a*. Next, a process of assembling a reciprocating type compressor 1 according to an embodiment will be described with reference to FIGS. 5 to 8.

Figure 5:
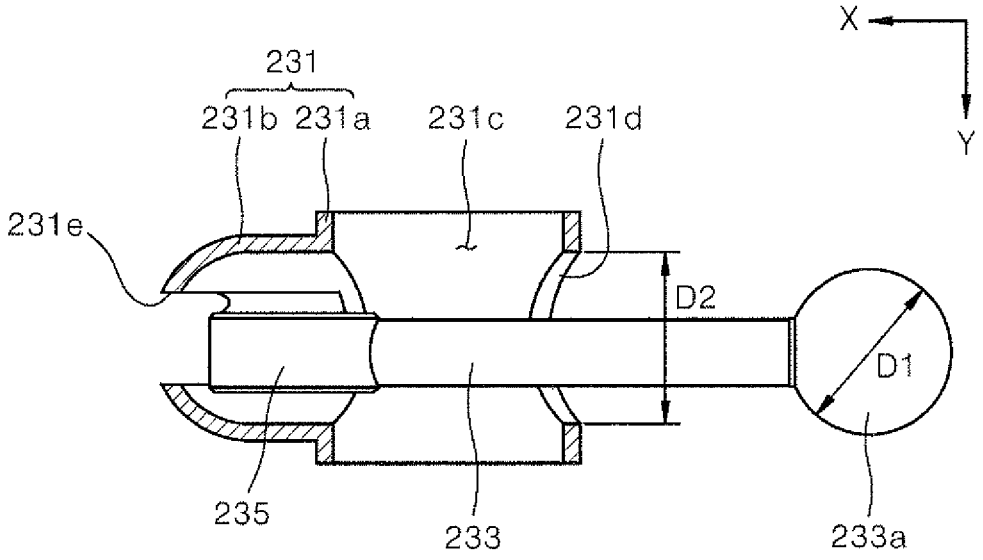
FIG. 5 illustrates a process of assembling a connecting rod included in a reciprocating type compressor according to an embodiment.

FIG. 5 is a view illustrating a process of assembling a connecting rod included in a reciprocating type compressor according to an embodiment. Referring to FIG. 5, in assembling the connecting rod 230 according to an embodiment, the shaft connecting portion 231 that includes the tubular body 231*a* and the rod portion 233 that has the ball bearing 233*a* at the first end thereof may be prepared.

The tubular body 231*a* may refer to a tubular member that is provided with a pin insertion hollow 231*c* into which a pin portion 131 (see FIG. 4) of a crank shaft 130 (see FIG. 4) may be inserted. The tubular body 231*a* may include the socket portion 231*b* that projects outwardly from a circumferential surface of the tubular body 231*a*. The socket portion 231*b* may have a size and a shape capable of receiving the ball bearing 233*a* that is provided at the first end of the rod portion 233.

The tubular body 231*a* may include two holes (hereinafter; the first and second insertion holes 231*d* and 231*e*) that face each other in a direction that intersects the pin insertion hollow 231*c*. The first insertion hole 231*d* may be provided at an opposite side of the socket portion 231*b*. The first insertion hole 231*d* may have a size such that the entire rod portion 233 that includes the ball bearing 233*a* at the first end thereof may pass therethrough.

According to this configuration, the entire rod portion 233 that includes the ball bearing 233*a* may pass through the first insertion hole 231*d* and enter toward the socket portion 231*b*. Specifically, the first insertion hole 231*d* may be a circular hole. A diameter D2 of the first insertion hole 231*d* may be equal to or greater than a diameter D1 of the ball bearing 233*a*. In other words, the first insertion hole 231*d* may have a size and a shape such that the ball bearing 233*a* may be inserted smoothly.

Figure 6:
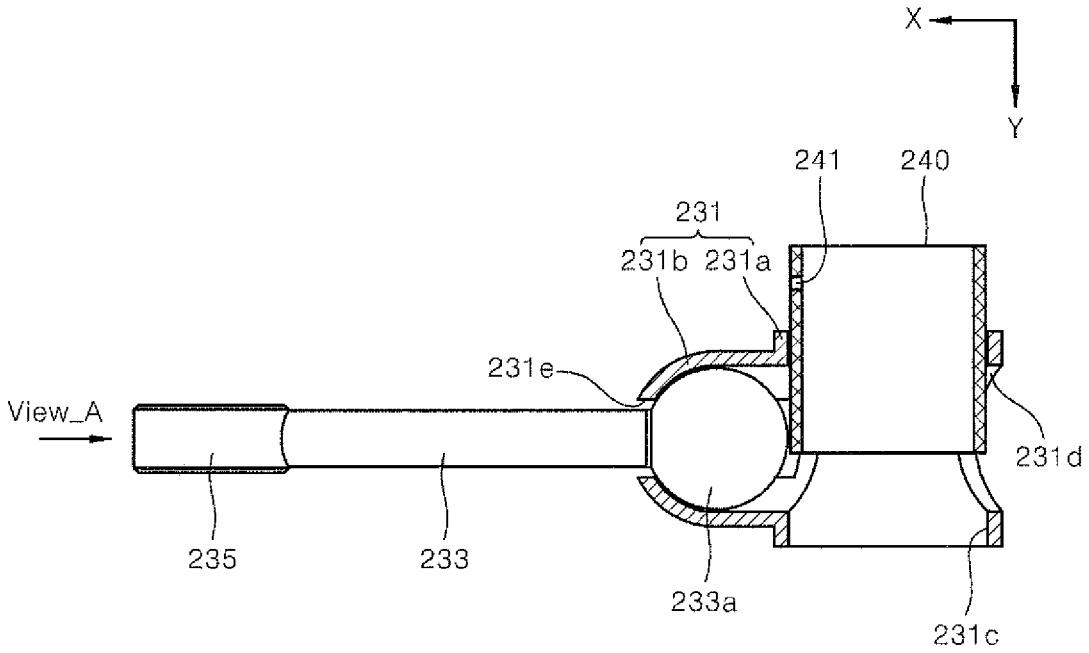
FIG. 6 illustrates a process of assembling a bushing bearing to a connecting rod included in a reciprocating type compressor according to an embodiment.

The second insertion hole 231*e* may be formed at the center of a projection portion of the socket portion 231*b* and may face the first insertion hole 231*d*. FIG. 6 is a view illustrating a process of assembling a bushing bearing to a connecting rod included in a reciprocating type compressor according to an embodiment.

Referring to FIG. 6, the rod portion 233 and the piston connecting portion 235 inserted through a first insertion hole 231*d* may be inserted through a second insertion hole 231*e*. However, at this time, only the ball bearing 233*a* may not pass through the second insertion hole 231*e* and a position thereof may be confined to the socket portion 231*b* and may be received thereto.

In other words, the second insertion hole 231*e* may have a size such that both the rod portion 233 and the piston connecting portion 235 except the ball bearing 233*a* may be inserted therethrough. Therefore, only the ball bearing 233*a* may be received in the socket portion 231*b*.

Figure 7:
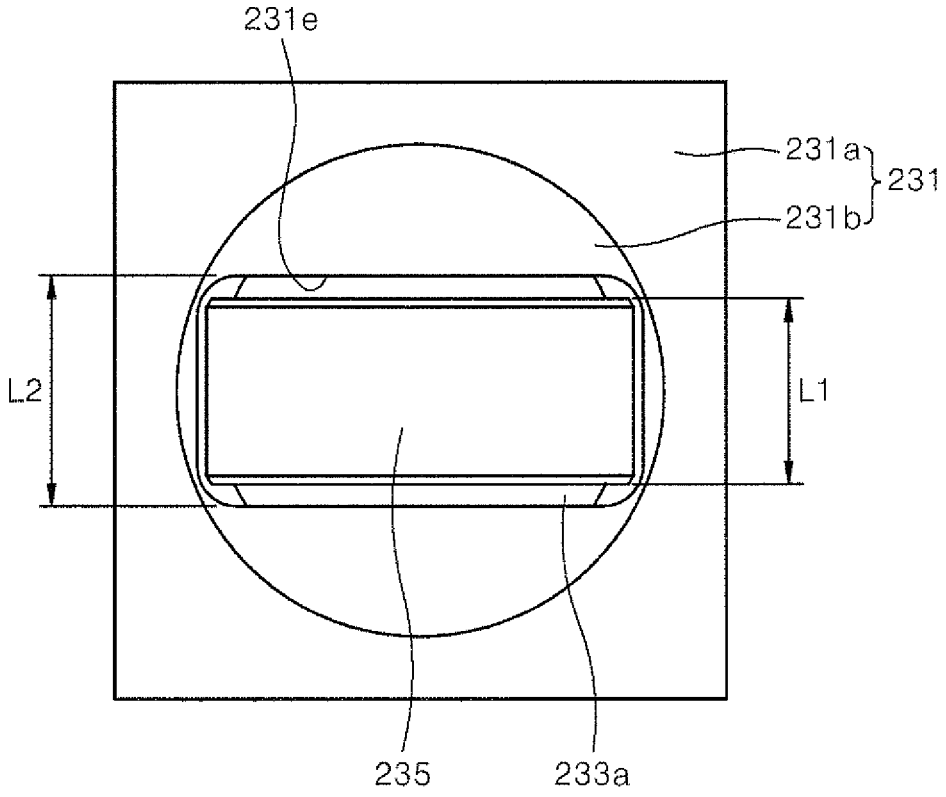
FIG. 7 is a front view as viewed from "View A" direction of FIG. 6.

FIG. 7 is a front view as viewed from a direction of "View A" in FIG. 6. Referring to FIG. 7, a second insertion hole 231*e* may have a shape corresponding to a frontal shape of a piston connecting portion 235. For example, the second insertion hole 231*e* may have a shape that is equal to or larger than the frontal cross-sectional shape of the piston connecting portion 235 (that is, L1<L2).

The second insertion hole 231*e* may have a rectangular hole shape rounded at each corner. As the second insertion hole 231*e* has such a shape, an entire rod portion except the ball bearing 233*a*, including the piston connecting portion 235, may be inserted through the second insertion hole 231*e*. Therefore, a ball joint type coupling may be made.

Figure 8:
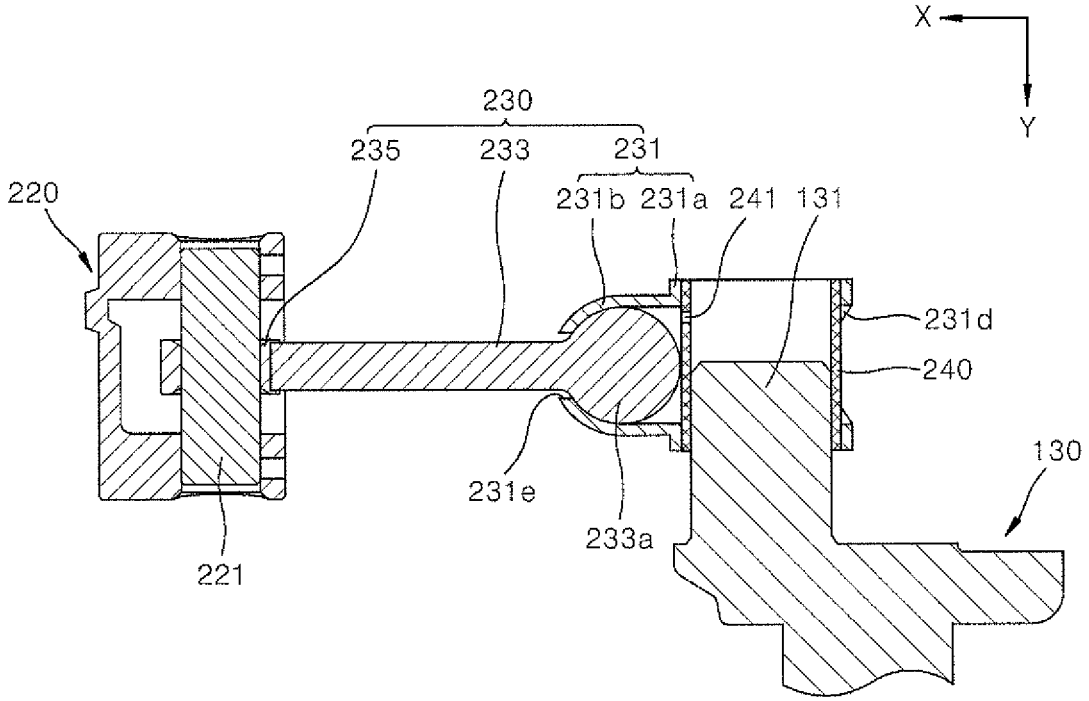
FIG. 8 illustrates a process of coupling a connecting rod and a crank shaft included in a reciprocating type compressor according to an embodiment.

Referring to FIG. 6, the ball bearing 233*a* may be received in or at an inner side of the socket portion 231*b*, and then, the bushing bearing 240 may be inserted into the tubular body 231*a* through the pin insertion hollow 231*c*. FIG. 8 is a view illustrating a process of coupling a connecting rod and a crank shaft included in a reciprocating type compressor according to an embodiment.

Referring to FIG. 8, the ball bearing 233*a* may be received inside of the socket portion 231*b* of the shaft connecting portion 231 and the ball bearing 233*a* may be contacted by a coupling of the bushing bearing 240, and thus, a ball joint-type connection may be made. The pin portion 131 of the crank shaft 130 may be coupled through an inner hollow of the bushing bearing 240.

The piston 220 may be coupled to the second end of the rod portion 233 that is connected to the shaft connecting portion 231 in a ball joint manner. The fastening pin 221 may penetrate the piston 220 and the piston connecting portion 235 so that their coupling can be made.

Figure 9:
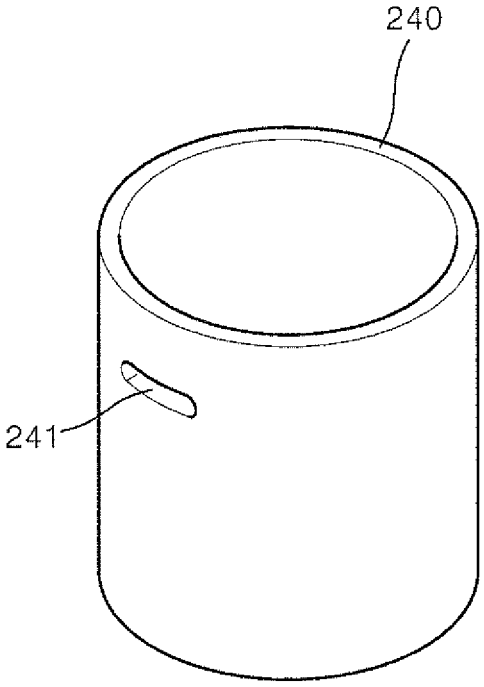
FIG. 9 is a perspective view schematically showing a bushing bearing included in a reciprocating type compressor according to an embodiment.

FIG. 9 is a perspective view schematically illustrating a bushing bearing included in a reciprocating type compressor according to an embodiment. Referring to FIG. 9, the bushing bearing 240 may have a tubular shape and may include at least one oil supply hole 241 that is formed by penetrating an inner circumferential surface and an outer circumferential surface of the bushing bearing 240. As seen in FIG. 8, the outer circumferential surface of the bushing bearing 240 may contact the ball bearing 233*a* (see FIG. 8) and the pin portion 131 (see FIG. 8) may be inserted through the inner hollow.

Figure 10:
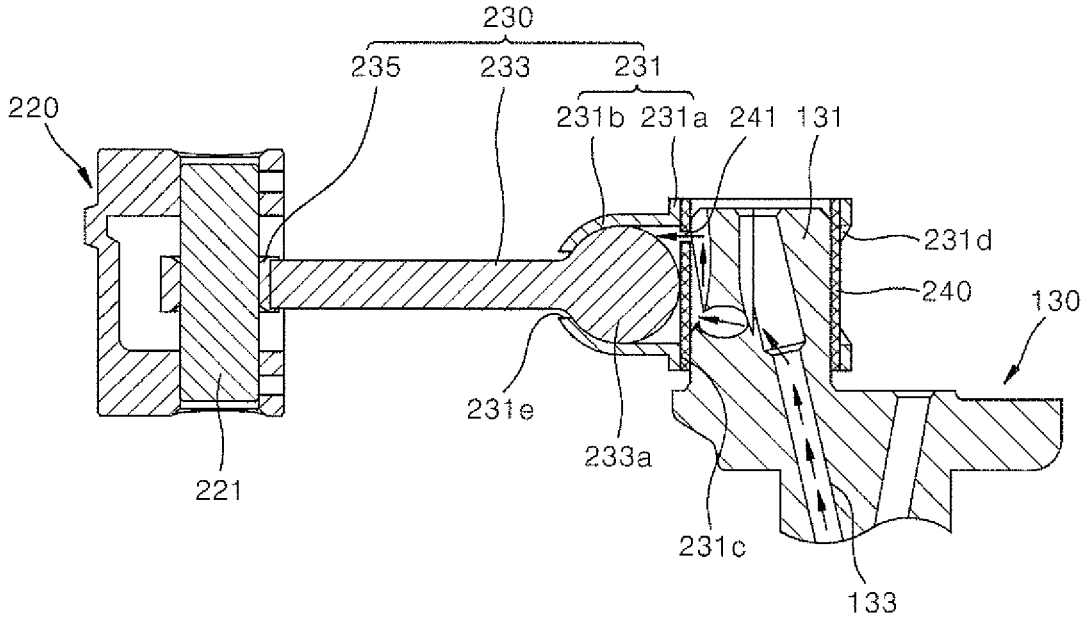
FIG. 10 illustrates an operation where oil to lubricate a ball bearing is provided through an oil supply hole of a bushing bearing in a reciprocating type compressor according to an embodiment.

FIG. 10 illustrates an operation where oil to lubricate a ball bearing is provided through an oil supply hole of a bushing bearing in a reciprocating type compressor according to an embodiment. Referring to FIG. 10, at least one or more of the oil supply hole 241, which penetrates an inner circumferential surface of the busing bearing 240 that the pin portion 131 may be inserted and an outer circumferential surface of the bushing bearing 240 that contacts the ball bearing 233*a*, may be provided.

At least one oil supply hole 241 may receive oil through the oil passage 133 of the crank shaft 130 during a compression (or an expansion) stroke of the piston 220 to lubricate the ball bearing 233*a*. At this time, a position of the oil passage 133 of the crank shaft 130 may be changed so that a supply stroke of oil may be appropriately adjusted.

As described above, according to a configuration and an operation of the embodiment, as the assembling of the crank shaft 130, the connecting rod 230, and the piston 220 may be simplified in the compressor, the assembling process may be simplified and the productivity of the product can be improved. Further, as the connection between the crank pin and the connecting rod may be possible through the ball joint and frictional resistance may be reduced, it may be possible to expect the performance improvement of the compressor.

Further, the durability life of the product can be increased. Further, a bushing may be added to lubricate a friction portion between the crank pin and the connecting rod, and lubricating oil may be provided through the oil supply hole of the crank shaft, thereby greatly reducing the frictional resistance.

A reciprocating type compressor according to an embodiment may include a crank shaft that is coupled to a rotor of a motor to transfer a rotational force, and a connecting rod that is coupled to a pin of the crank shaft to convert a rotational force of the crank shaft into a linear motion of a piston, and the connecting rod may include a shaft connecting portion that has a tubular body that is provided with a pin insertion hollow that a pin portion of the crank shaft is inserted and a socket portion that projects from the tubular body, and a piston connecting portion that is formed at an opposite side of the shaft connecting portion and coupled to the piston, and a rod portion that is formed between the shaft connecting portion and the piston connecting portion and has a ball bearing that is received in the socket portion.

At this time, in the tubular body, a first insertion hole capable of allowing the ball bearing to penetrate the tubular body may be provided at an opposite side of a position where the socket portion projects. The socket portion may be provided with a second insertion hole capable of penetrating the rod portion and the piston connecting portion, except the ball bearing.

Further, the first insertion hole may be a circular hole that has a diameter equal to or larger than a diameter of the ball bearing. The second insertion hole may be a rectangular hole that has a shape equal to or larger than a frontal shape of the piston connecting portion.

According to another embodiment, a reciprocating type compressor may include a crank shaft that is coupled to a rotor of a motor portion to transfer a rotational force; a connecting rod that is coupled to a pin portion of the crank shaft to convert a rotational force of the crank shaft into a linear motion of a piston; wherein the connecting rod may include a shaft connecting portion that has a tubular body that is provided with a pin insertion hollow that a pin portion of the crank shaft is inserted and a socket portion that projects from the tubular body, and a piston connecting portion that is formed at an opposite side of the shaft connecting portion and is coupled to the piston, and a rod portion that is formed between the shaft connecting portion and the piston connecting portion and has a ball bearing that is received in the socket portion, and may further include a bushing bearing that is inserted through the pin insertion hollow so that it is closely contacted to an inner circumferential surface of the tubular body and is interposed between the tubular body and the pin portion.

At this time, the bushing bearing may contact the ball bearing that is received in the socket portion through an outer circumferential surface. Further, the bushing bearing may include at least one oil supply hole that penetrates an inner circumferential surface where the pin portion is inserted and an outer circumferential surface that contacts the ball bearing. The bushing bearing may receive oil from an oil passage of the crank shaft by using at least one oil supply hole to use it to a lubrication of the ball bearing, thereby reducing a frictional resistance.

According to the reciprocating type compressor of the embodiments, as an assembly among the crank shaft, the connecting rod, and the piston may be simplified in the compressor, the assembling process may be simplified and the productivity of the product may be improved. Further, according to the reciprocating type compressor of the embodiments, a frictional resistance may be reduced through a fastening structure among the crank shaft, the connecting rod, and the piston. As a result, it may be possible to expect a performance improvement of the compressor. Further, a durability life of the product may be increased.

Embodiments are described with reference to illustrative drawings, but are not limited by the embodiments described herein and accompanying drawings. It should be apparent to those skilled in the art that various changes which are not exemplified herein but are still within the spirit and scope may be made. Further, it should be apparent that, although an effect from a configuration is not clearly described in the embodiments, any effect, which can be predicted from the corresponding configuration, is also to be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating type compressor, comprising:

a crank shaft configured to be coupled to a rotor of a motor to receive a rotational force of the motor;

a connecting rod configured to be coupled to a pin of the crank shaft to convert the rotational force of the crank shaft into a linear motion of a piston, wherein the connecting rod comprises:

a first end that includes a tubular body having a pin insertion hole into which the pin of the crank shaft is inserted and a socket that projects from the tubular body;

a second end formed at an opposite side of the first end and configured to be coupled with the piston; and a main body that extends between the first end and the second end and includes a ball configured to be received in the socket, wherein the tubular body includes a first insertion hole through which the ball is configured to pass provided at a side opposite to a side from which the socket projects, and wherein the socket includes a second insertion hole through which the second end and the main body are configured to pass.

2. The reciprocating type compressor of claim 1, wherein the first insertion hole is a circular hole having a diameter equal to or larger than a diameter of the ball.

3. The reciprocating type compressor of claim 1, wherein the second insertion hole is a rectangular hole having a shape equal to or larger than a cross section of the second end.

4. The reciprocating type compressor of claim 1, further comprising a bushing configured to be inserted into the pin insertion hole such that the bushing contacts an inner circumferential surface of the tubular body and is interposed between the tubular body and the pin of the crankshaft.

5. The reciprocating type compressor of claim 4, wherein an outer circumferential surface of the bushing contacts the ball which is received inside of the socket.

6. The reciprocating type compressor of claim 4, wherein the bushing comprises at least one oil supply hole that penetrates an inner circumferential surface and an outer circumferential surface of the bushing.

7. The reciprocating type compressor of claim 6, wherein the bushing is configured to receive oil from an oil passage of the crank shaft using the at least one oil supply hole to lubricate the ball.

8. A reciprocating type compressor, comprising:

a motor comprising a stator that is supported by a frame inside of a hermetic container, and a rotor that rotates inside of the stator; and a compression assembly that is installed in an upper side of the motor and receives a rotational force from the rotor to compress a refrigerant, wherein the motor and compression assembly collectively comprise:

a crank shaft configured to be coupled to the rotor to transfer a rotational force of the motor to the crank shaft; and a connecting rod configured to be coupled to a pin of the crank shaft and convert the rotational force of the crank shaft into a linear motion of a piston, wherein the connecting rod comprises:

a first end including a tubular body that includes a pin insertion hole through which the pin of the crank shaft is configured to be inserted and a socket that projects from the tubular body;

a second end configured to be coupled to the piston; and a main body that extends between the first end and the second end and having a ball configured to be received inside of the socket, wherein the tubular body includes a first insertion hole through which the ball is configured to pass provided at a side opposite to a side from which the socket projects, and wherein the socket includes a second insertion hole through which the second end and the main body are configured to pass.

9. The reciprocating type compressor of claim 8, wherein the motor is a constant-speed motor or an inverter motor capable of forward and reverse rotation.

10. The reciprocating type compressor of claim 8, wherein the first insertion hole is a circular hole having a diameter equal to or greater than a diameter of the ball, and wherein the second insertion hole is a rectangular hole having a shape equal to or larger than a cross section of the second end.

11. The reciprocating type compressor of claim 8, further comprising a bushing configured to be inserted through the pin insertion hole such that the bushing contacts an inner circumferential surface of the tubular body and is interposed between the tubular body and the pin of the crankshaft.

12. The reciprocating type compressor of claim 11, wherein an outer circumferential surface of the bushing contacts the ball which is received inside of the socket.

13. The reciprocating type compressor of claim 11, wherein the bushing comprises at least one oil supply hole that penetrates an inner circumferential surface and an outer circumferential surface of the bushing, and wherein the bushing is configured to receive oil from an oil passage of the crank shaft using at least one oil supply hole to lubricate the ball.

14. A reciprocating type compressor, comprising:

a crank shaft configured to be rotated by a motor and including an oil passage and a pin;

a shaft connector configured to be connected to the crank shaft, the shaft connector including a tubular body into which the pin is configured to be inserted and a socket that extends from an outer circumferential surface of the tubular body;

a connecting rod configured to be connected to the shaft connector and including a first end comprising a ball that is inserted into the socket to create a ball joint; and a piston configured to be connected to a second end of the connecting rod opposite the ball, wherein the oil passage allows oil to flow into the ball joint, wherein a first insertion hole is formed on the outer circumferential surface of the tubular body opposite the socket and a second insertion hole is formed at a distal end of the socket, and wherein the connecting rod is configured to be inserted through the first and second insertion holes such that the ball is inserted into the socket to create the ball joint.

15. The reciprocating type compressor of claim 14, further comprising a bushing configured to be inserted into and contact an inner circumferential surface of the tubular body, the bushing including at least one oil supply hole that allows the oil from the oil supply passage to flow into the ball joint through the bushing.

16. The reciprocating type compressor of claim 15, wherein the bushing is inserted into the tubular body after the connecting rod is inserted through the first and second insertion holes such that an outer circumferential surface of the bushing contacts the ball and an inner circumferential surface of the bushing contacts the pin.

17. The reciprocating type compressor of claim 15, wherein a width of the first insertion hole is greater than a diameter of the ball, and a width of the second insertion hole is less than the diameter of the ball.

* * * * *